United States Patent [19]

Dougherty et al.

[11] Patent Number: 4,836,806

[45] Date of Patent: Jun. 6, 1989

[54] PIN CONNECTOR

[75] Inventors: Michael J. Dougherty, Lansdale; Alan S. Olshansky, Phoenixville, both of Pa.

[73] Assignee: Microdot Inc., Darien, Conn.

[21] Appl. No.: 195,814

[22] Filed: May 19, 1988

Related U.S. Application Data

[63] Continuation-in-part of Ser. No. 544,484, Oct. 24, 1983, abandoned.

[51] Int. Cl.[4] ..... H01R 13/428

[52] U.S. Cl. ..... 439/751; 439/82

[58] Field of Search ..... 439/82, 751, 825–827, 439/873

[56] References Cited

U.S. PATENT DOCUMENTS

| | | | |
|---|---|---|---|
| 3,545,080 | 12/1970 | Evans | 29/874 |
| 3,663,930 | 5/1972 | Henschen et al. | 439/660 |
| 3,743,979 | 7/1973 | Schor | 333/183 |
| 3,997,237 | 2/1976 | White | 439/876 |
| 4,066,326 | 1/1978 | Lovendusky | 439/873 |
| 4,362,353 | 12/1982 | Cobaugh et al. | 439/825 |
| 4,443,053 | 4/1984 | Astbury | 403/365 |

FOREIGN PATENT DOCUMENTS

| | | | |
|---|---|---|---|
| 0198408 | 10/1986 | European Pat. Off. | 439/82 |

*Primary Examiner*—Gary F. Paumen

*Attorney, Agent, or Firm*—Lyman R. Lyon

[57] ABSTRACT

An improved pin connector system comprising a compliant pin that effects a resilient interference fit within a complementary circular aperture of a printed circuit board. The pin utilizes an improved three beam configuration that optimizes electrical continuity, load distribution and mechanical stability, yet minimizes insertion force. The compliant pin exhibits improved contact wiping upon insertion and superior anti-torque and retention force characteristics after insertion.

9 Claims, 2 Drawing Sheets

PIN CONNECTOR

CROSS REFERENCE TO RELATED APPLICATIONS

The present application is a continuation-in-part of U.S. patent application Ser. No. 06/544,484 entitled "Compliant Pin," filed by the same parties on Oct. 24, 1983, and now abandoned.

BACKGROUND OF THE INVENTION

Compliant pins are used to facilitate an electrical connection between, for example, printed circuit boards and associated circuitry. In the typical pin connector system, upon insertion of a compliant pin into a complementary circuit board aperture, a portion of the pin mechanically engages with the electrically-conductive sidewall of the aperture to achieve and maintain a positive electrical connection therewith. It is desirable that the compliant pin effect resilient engagement with the aperture so that contact pressure is maintained while ensuring that such pins may be inserted into the circuit board in a high density array without requiring excessive installation force. Stated in another manner, the resilient flexing of the mounting portion of a compliant pin most preferably provides a pin retention force that is equal to or only slightly less than the insertion force required for pin installation.

It is to be emphasized that the mechanical engagement between the pin and aperture sidewall must be of a non-destructive nature in order to avoid damage to either the pin or aperture sidewall which would tend to severely limit connector system performance and integrity. By way of example, it is noted that Military Specification MIL-C-28,859 requires that the aperture withstand repeated pin installation and removal with only minimal sidewall deformation.

Additionally, the mechanical engagement between the pin and aperture must be such that the installed pin is capable of resisting applications of torque thereto as may occur, for example, when making wire-wrap connections to an exposed end of the pin subsequent to its installation in the circuit board. Indeed, it will be appreciated that a small measure of torsional loading on the pin inevitably occurs during its installation or removal. Torsional resistance is further required in order to maintain the proper alignment between the pin and circuit board and to preclude an electrical short circuit between adjacent pins. Most preferably, torsional loads are absorbed by the resilient flexing of the mounting portion of the compliant pin itself, thereby avoiding the scoring and/or wholesale destruction of opposed pin connector and aperture sidewall contact surfaces which would otherwise result from relative rotation therebetween.

Another difficulty encountered in pin connector systems is the formation of oxides and other surface films on the exposed contact surfaces of both the pin connector and the aperture sidewall prior to the mechanical engagement therebetween. The films, which in large part survive the axial contact wiping generated between the pin and aperture during pin installation, ultimately reduce the quality of the electrical connection achieved by known connector systems. It is therefore desirable to promote circumferential, as well as axial, contact wiping of the aperture sidewall with the individual beams of the pin connector mounting portion during connector system assembly.

Known pin connectors generally utilize a split wall or twin beams that are radially contractable upon insertion of the pin into an aperture thereby to provide a positive electrical and mechanical connection to the circuit board. An example of a compliant pin heretofore known and used is found in U.S. Pat. No. Re. 29,513 reissued Jan. 10, 1978, to Johnson. It is noted that such known "needle-eye" configurations also include compliant pins having three beams which are equi-spaced about the connector periphery, as taught in U.S. Pat. No. 3,545,080 issued Dec. 8, 1970, to Evans.

The problem with pins of conventional needle-eye design is that, in order to meet the force requirements incident to insertion, retention and torque, such known pins are relatively stiff. As a result, a large insertion force is typically required, and the aperture in the printed circuit board often complies more than the pin. This results in significant hole deformation, both electrical and mechanical damage to the circuit board, and ultimate compromise of the integrity of the electrical circuit. Such deformation of the aperture additionally limits the resilient retention force achievable by the pin while encouraging additional aperture damage upon the torsional loading of the pin.

The prior art further teaches pin connectors having a mounting portion comprising three beams disposed in a triangular array wherein the first beam extends lengthwise in cross-section radially away from the central longitudinal axis of the pin and the second and third beams, offset from said longitudinal axis, extend in cross-section laterally away from the first beam, as described in U.S. Pat. No. 3,997,237 issued Dec. 14, 1976 to White. However, such pins fail to provide sufficient retention force and reusability, as pin installation is characterized by the relative sliding and subsequent jamming together of the beams thereof, whereby little resilient radial biasing of the beams is available for pin connector retention and the achievement of a positive electrical contact. Indeed, it is noted that the patent to White is directed to supplying solder into the aperture subsequent to pin installation, whereafter the pin is soldered into place in order to provide both sufficient pin retention force and positive electrical contact.

Still further, severe deformation of the aperture itself is likely to occur upon insertion of the White pin therein, in as much as the beams are essentially wedged into the aperture. And, subsequent to its installation, the beam configuration taught by White is unable to resist torque in a non-destructive manner, as it provides no compliance within the mounting portion of the pin itself to prevent the beams from gouging the aperture sidewall.

SUMMARY OF THE INVENTION

It is an object of the instant invention to provide an electrical connector system characterized by resilient, non-destructive engagement between a pin connector and the sidewall of a complementary aperture.

It is also the object of the instant invention to provide an electrical pin connector system characterized by high pin retention force, improved torsional resistance, and an electrical connection of superior quality.

A further object of the instant invention is to provide an electrical pin connector system exhibiting a pin retention force which is nearly equal to the force required for connector system assembly.

A further object of the instant invention is to provide an electrical pin connector system which resiliently accommodates torsional loading thereof, whereby relative movement between opposed pin connector and aperture contact surfaces subsequent to initial connector system assembly is avoided.

A further object of the instant invention is to provide an electrical pin connector system wherein enhanced circumferential contact wiping of engaging surfaces of both the pin connector and aperture sidewall is achieved during connector system assembly.

An electrical pin connector system in accordance with the instant invention comprises a compliant pin having a shank portion that is split into three beams which resiliently mechanically engage with the electrically-conductive sidewall of a circular aperture in a printed circuit board or other mounting member. More specifically, the mounting portion of the pin comprises three longitudinally-extending resilient beams that are radially spaced from one another about a central axis and disposed in a generally triangular array. Each of the beams is provided with an arcuate edge surface thereon for engagement with the aperture sidewall, with the radius of generation of each arcuate edge surface being equal to or less than the radius of the aperture in order to prevent the scoring of the aperture sidewall therewith during connector system assembly and disassembly. The pin has conventional wire-wrap, solder or mechanical terminations extending above and below the circuit board, of any desired configuration.

Upon insertion of the pin into the aperture, the first and second outer beams initially engage with the aperture sidewall at a pair of diametric locations thereon, respectively, with the third, intermediate beam initially engaging with the aperture sidewall at a third location thereon midway between the initial diametric sidewall engagement locations of the outer beams. Subsequent to such initial engagement, the locations of engagement between the outer beams and the aperture sidewall, respectively, are displaced circumferentially about the aperture sidewall away from the location of intermediate beam engagement thereon.

The resilient radial biasing of the flexed beams of the pin's mounting portion against the sidewall of the aperture during connector system assembly ensures secure mechanical mounting of the pin in the aperture as well as positive electrical contact therebetween. Moreover, the outer beams undergo torsional loading upon such circumferential displacement of the locations of engagement between the beams and the aperture sidewall away from the location of intermediate beam engagement thereon. As a result, the outer beams are each resiliently rotated about their respective longitudinal axes, thereby providing for increased pin retention force. Such torsional preloading of the outer beams further provides the assembled pin connector system with an increased resistance to the application of torsional loads thereto.

In accordance with another feature of the instant invention, the central axis of the mounting portion of the pin is diametrically displaced relative to the aperture away from the location of engagement between the third, intermediate beam and the aperture sidewall subsequent to initial engagement therebetween. Such displacement of the central axis of the mounting portion of the pin provides the intermediate beam with an increased moment arm with which to further stabilize the pin's angular relationship with the aperture. It is noted that the ability of the intermediate beam to resiliently "float" between the outer beams subsequent to the assembly of the pin connector system of the instant invention, in combination with the torsional preloading of the outer beams achieved during such system assembly, ensures the resilient accommodation of torsional loads within the mounting structure of the connector system itself without resort to deleterious relative rotation between the pin and the aperture, as is typically found in prior art pin connector systems.

DETAILED DESCRIPTION OF THE PREFERRED EMBODIMENT OF THE INVENTION

Figure 1:
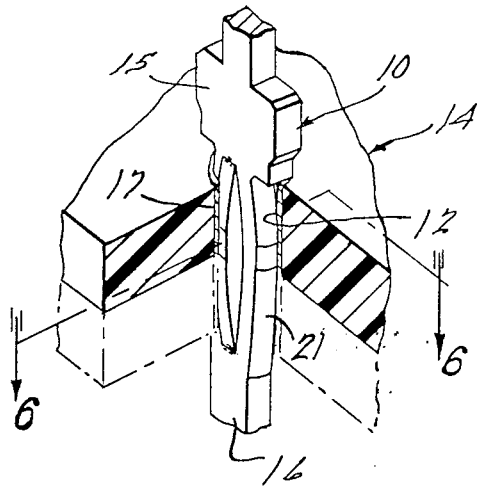
FIG. 1 is a perspective view, partially broken away, of an assembled pin connector system in accordance with the instant invention.

As seen in FIG. 1, a compliant pin 10, in accordance with a constructed embodiment of the instant invention, is preferably fabricated from a singe piece of flat metal or other conductive material and adapted to be press into an aperture 12 in a printed circuit board 14. The pin 10 is adapted to be electrically connected to conductors of any desired configuration at an upper terminal or head portion 15 and a lower terminal or tail portion 16 thereof (not shown), as well as to be electrically connected to conductive plating 17 within the aperture 12 in the circuit board 14. A minimum thickness circuit board 14 is illustrated in solid lines, the dashed lines indicating the degree of penetration of the pin 10 in a maximum thickness circuit board.

Figure 2:
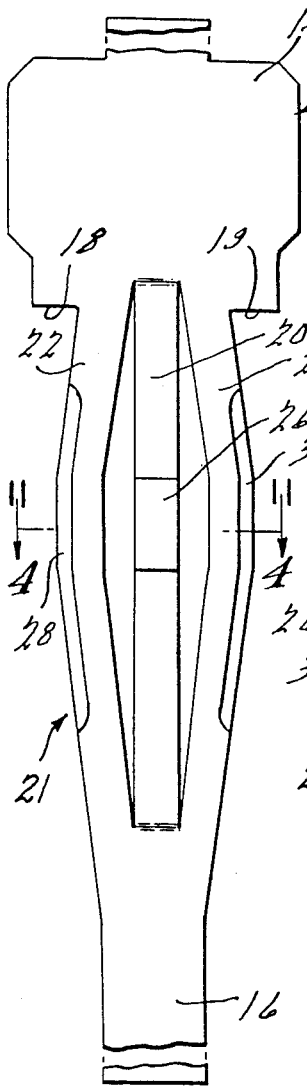
FIG. 2 is an elevational view of the compliant pin of FIG. 1, partly broken away.
Figure 3:
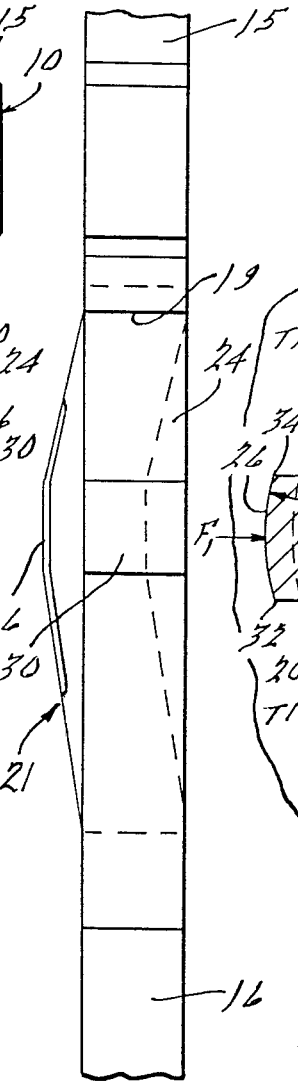
FIG. 3 is a side elevational view of the pin of FIG. 2.

As shown in detail in FIGS. 2 and 3, the head portion 15 of the pin 10 has shoulders 18 and 19 thereon that limit penetration of the pin 10 into the circuit board 14. A shank portion 21 of the pin 10 comprises two outboard beams 22 and 24, and a third beam 20 disposed therebetween. The beams 20, 22 and 24 are disposed in a generally triangular array thereby to mount the pin 10 within the aperture 12 in the circuit board 14.

Figure 4:
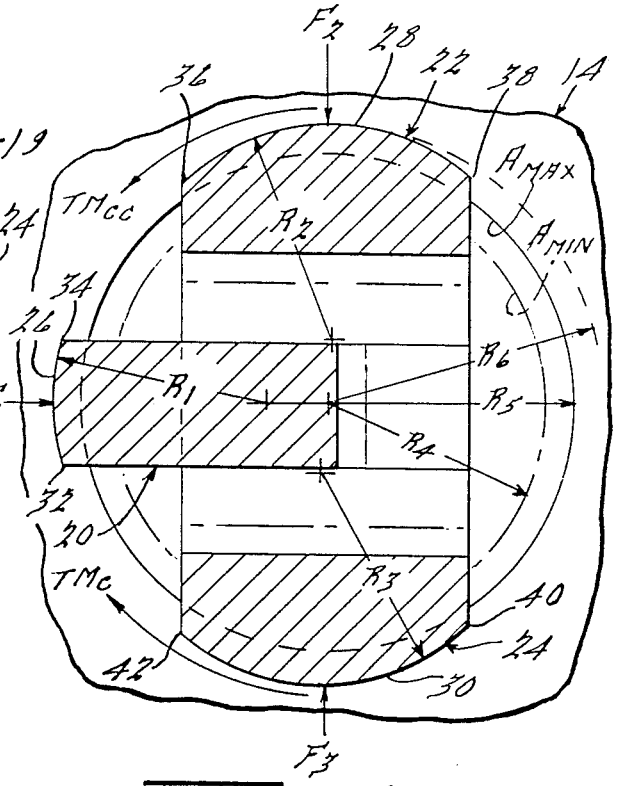
FIG. 4 is a cross-sectional view of the pin taken substantially along the line 4—4 of FIG. 2, rotated 90° clockwise, and shown in relation to a maximum and minimum diameter aperture in a circuit board.

More specifically, the beams 20, 22 and 24 are bent radially outwardly during formation of the pin's mounting portion 21 so that the beams are radially spaced from one another with the arcuate edge surfaces 26, 28 and 30 thereof lying in and defining a circle of predetermined diameter greater than the maximum diameter of the aperture 12 in the circuit board 14. As best seen in FIG. 4, the beams 20, 22 and 24 are initially expanded during pin manufacture to describe with the arcuate edge surfaces 26, 28 and 30 thereof a circle having a radius $R_6$, said radius $R_6$ being greater than the radius $R_5$ of a maximum size aperture $A_{max}$. Thus, when the pin 10 is inserted into an aperture 12 having a radius equal to or less than the radius $R_5$ of a maximum size aperture $A_{max}$, the beams 20, 22 and 24 of the mounting portion 21 thereof contract radially inwardly, with the arcuate edge surfaces 26, 28 and 30 of beams 20, 22 and 24, respectively, making line contact with the aperture sidewall 17 at three distinct locations $L_3$, $L_1$ and $L_2$ thereabout, respectively, in the manner described hereinbelow.

It is noted that the arcuate edge surfaces 26, 28 and 30 of beams 20, 22 and 24 are provided with radii of development $R_1$, $R_2$ and $R_3$, respectively, each being equal to the radius $R_4$ of a minimum aperture $A_{min}$, as illustrated in FIG. 4. Thus, when the pin 10 is inserted into a minimum aperture $A_{min}$ in the circuit board 14, the beams 20, 22 and 24 will be radially inwardly contracted to the extent that the arcuate edge portions 26, 28 and 30 thereon, respectively, are concentric with the inner surface of the aperture $A_{min}$. As a result, the arcuate edge surfaces 26, 28 and 30 of beams 20, 22 and 24, respectively, never engage the aperture 12 of the circuit board 14 in a manner that brings the circumferentially spaced side corners 32–34, 36–38 and 40–42 thereof into biting contact with the aperture sidewall 17. The aforesaid relationship precludes scoring of the aperture 12 and compromise of circuit board 14 integrity.

Figure 5:
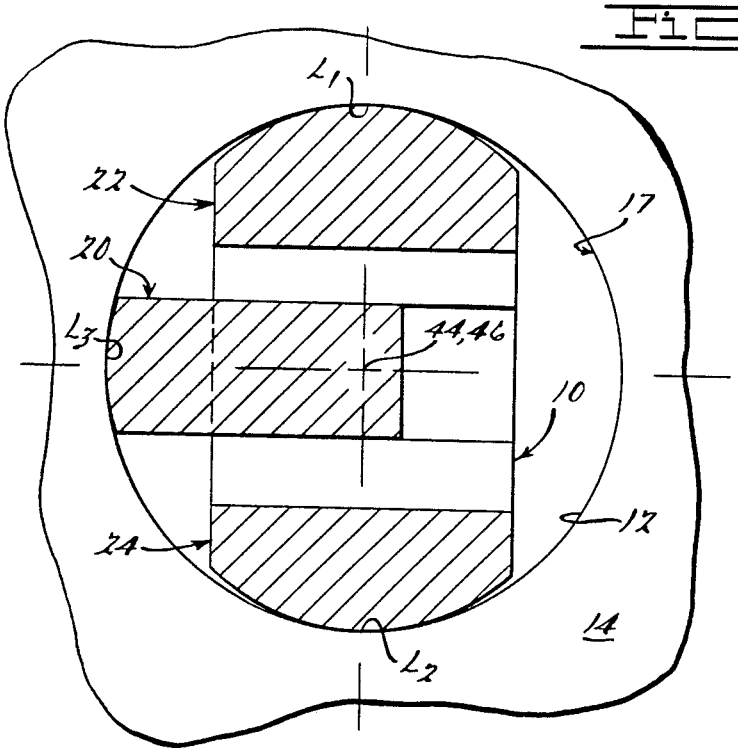
FIG. 5 is a cross-sectional view of the pin within the plane of the upper surface of the circuit board upon initial engagement of the mounting portion of the pin with the aperture sidewall.
Figure 6:
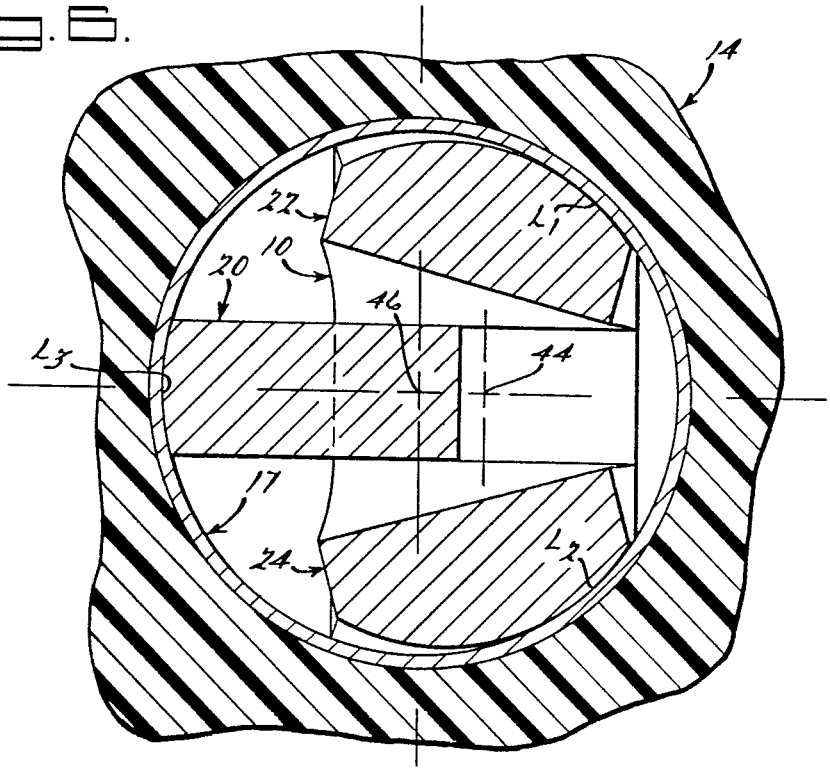
FIG. 6 is a cross-sectional view of the assembled pin connector system taken substantially along line 6—6 of FIG. 1.

Upon installation of the pin 10 into the mounting aperture 12 in circuit board 14, the arcuate edge surfaces 26, 28 and 30 of the beams 20, 22 and 24, respectively, engage the conductive sidewall 17 of the aperture 12 in the following manner: the outer beams 22 and 24 initially engage with the aperture sidewall 17 at a pair of diametric locations $L_1$ and $L_2$ thereon, respectively, with the third, intermediate beam 20 initially engaging with the aperture sidewall 17 at a third location $L_3$ thereon midway between the initial diametric sidewall engagement locations $L_1$ and $L_2$ of outer beams 22 and 24, as illustrated in FIG. 5. Subsequent to such initial engagement, further insertion of the mounting portion 21 of the pin 10 into the aperture 12 causes the outer beam engagement locations $L_1$ and $L_2$ to be displaced, respectively, circumferentially about the aperture sidewall 17 away from the location of intermediate beam engagement $L_3$ thereon, as illustrated in FIG. 6. Such circumferential beam displacement provides enhanced circumferential contact wiping of engaging pin connector and aperture sidewall surfaces.

The diametric displacement of the central axis 44 of the pin's mounting portion 21 relative to the mounting aperture 12 accompanies such circumferential displacement of the outer beam engagement locations $L_1$ and $L_2$ on the aperture sidewall 17 away from intermediate beam engagement location $L_3$ thereon, as illustrated in FIG. 6. It will be readily appreciated that the entire pin 10 is moved radially to the right as shown in FIGS. 4–6 upon its insertion into the circuit board 14 by a radial force $F_1$ indicated in FIG. 4, to which there is no initial counteracting force by virtue of the purely diametric initial engagement of the outer beams 22 and 24 with the aperture sidewall 17. The central axis 44 of the pin's mounting portion 21 is thus displaced from initial alignment with the central axis 46 of the aperture 12 along the diameter passing through, and in the direction away from, the location of third beam engagement $L_3$ on the aperture sidewall 17, to a position radially offset therefrom.

Concomitantly, upon such circumferential displacement of outer beam engagement locations $L_1$ and $L_2$ away from intermediate beam contact location $L_3$, the outer beams 22 and 24 are biased radially inwardly under the influence of radial forces $F_2$ and $F_3$, resolution of the aforesaid forces resulting in the inducement of a counterclockwise torsional moment $TM_{cc}$ within beam 22 and a clockwise torsional moment $TM_c$ within beam 24. The aforesaid torsional moments $TM_{cc}$ and $TM_c$ effect contact wiping between the edge surfaces 28 and 30 on beams 22 and 24, respectively, and the electrically conductive surface 17 of the aperture 12 in the circuit board 14 by ensuring a resiliently biased contact therebetween.

Moreover, as a result of such torsional loading, each of the outer beams 22 and 24 is resiliently rotated about its respective longitudinal axis. This torsional flexing of the outer beams 22 and 24 increases the resilient bias of the beams against the aperture sidewall 17 which, in turn, provides for significantly increased pin retention force. For example, a series of tests upon a pin connector system constructed in accordance with the instant invention and in conformity with Military Specification MIL-C-28,859 generated the following results:

| | Pin of Instant Invention | | | Prior Art "Needle-Eye" |
|---|---|---|---|---|
| Force (lbs) | Min. | Max. | Ave. | (Typ.) |
| Insertion Force | 11.0 | 15.2 | 13.1 | >30 |
| Retention Force | 9.0 | 13.0 | 10.8 | 11 |

Thus, a pin connector system constructed in accordance with the instant invention achieves a pin insertion/retention force ratio which approaches 1:1 while exhibiting an insertion force substantially less than that typical of prior art "needle-eye" configurations.

In accordance with yet another feature of the instant invention, the pin 10 is stabilized against rotation by the intermediate beam 20 since it essentially "floats" between the beams 22 and 24 thereby to provide a counter torque to any twisting moment applied to the upper terminal or head portion 15 or lower terminal or tail portion 16 of the pin 10. Additionally, reference to FIG. 6 clearly shows the increased moment arm M which results from the shifting of the central axis 44 of the pin's mounting portion 10 away from the central axis 46 of the aperture 12 during the installation of the pin 10 thereinto, whereby an additional resistance to twisting is obtained. Moreover, it will be readily appreciated that the torsional preloading of beams 22 and 24 further bolsters the torsional resistance of the pin 10 subsequent to the installation thereof within aperture 12. These antitorque features result in the maintenance of a desired orientation for the upper and lower terminal portions 15 and 16 of the pin 10 relative to the circuit board 14 to ensure electrical spacing between adjacent pins.

While the preferred embodiment of the invention has been disclosed, it should be appreciated that the invention is susceptible of modification without departing from the scope of the following claims.

We claim:

1. In an electrical connector system comprising a pin having a head portion, a tail portion spaced from the head portion, and a mounting portion intermediate the head and tail portions comprising three resilient, longitudinally-extending beams; and a mounting member having a circular aperture with an electrically-conductive sidewall dimensioned to receive the mounting portion of said pin;

the improvement comprising the three resilient beams of the mounting portion of said pin being radially spaced from one another about a central axis and disposed in a generally triangular array, each of the beams having an arcuate edge surface thereon for engagement with the aperture sidewall, the first and second beams initially engaging the aperture sidewall at a pair of diametric locations thereon, respectively, the third beam engaging the aperture sidewall at a third location thereon midway between said initial diametric locations, said locations of engagement between the first and second beams and the aperture sidewall, respectively, being displaced circumferentially about the aperture sidewall away from said third beam engagement location thereon upon further insertion of said pin into the aperture.

2. A connector system in accordance with claim 1 wherein the radius of development of the arcuate edge surfaces of the beams is equal to or less than the radius of the aperture of said mounting member.

3. A connector system in accordance with claim 1 wherein the first and second beams experience torsional loading upon such circumferential movement of said engagement locations about the aperture sidewall.

4. A connector system in accordance with claim 3 wherein each of the first and second beams is resiliently rotated about its respective longitudinal axis by such torsional loading.

5. A connector system in accordance with claim 1 wherein the central axis of the mounting portion of said pin is diametrically displaced relative to the aperture of said mounting member away from said third beam engagement location on the aperture sidewall upon such further insertion of said pin into the aperture of said mounting member.

6. A connector system in accordance with claim 1 wherein the central axis of the mounting portion of said pin is displaced from initial alignment with the central axis of the aperture to a position radially offset therefrom upon such further insertion of said pin into the aperture of said mounting member.

7. A connector system in accordance with claim 6 wherein the central axis of the mounting portion of said pin is displaced along the diameter of the aperture passing through, and in the direction away from, said third beam engagement location on the aperture sidewall.

8. An electrical connector system comprising a mounting member having a circular aperture with an electrically-conductive sidewall; and a pin for insertion into the aperture of said mounting member having three resilient longitudinally-extending beams radially spaced from one another about a central axis and disposed in a generally triangular array, an arcuate edge surface of each said beam engaging the aperture sidewall at a discrete location thereon, two of said locations initially being diametrically-opposed, the third location being situated midway between said initial diametrically-opposed locations, each of said initially diametrically-opposed locations being displaced, respectively, circumferentially about the aperture sidewall away from said third location upon further insertion of said pin into the aperture.

9. A connector system in accordance with claim 8 wherein the radius of development of each of the arcuate edge surfaces of the beams is equal to or less than the radius of the aperture of said mounting member.

* * * * *